US005964229A

United States Patent [19]

Brendel

[11] Patent Number: 5,964,229

[45] Date of Patent: Oct. 12, 1999

[54] DEVICE FOR OR IN GARBAGE TRUCKS

[75] Inventor: Jürgen Brendel, Pottenstein, Germany

[73] Assignee: Baier & Koppel GmbH & Co., Pegnitz, Germany

[21] Appl. No.: 08/967,864

[22] Filed: Nov. 12, 1997

[51] Int. Cl.[6] ..... B08B 3/02

[52] U.S. Cl. ..... 134/52; 134/53; 134/62; 134/152; 134/153; 134/201; 134/115 R

[58] Field of Search ..... 422/28, 32; 134/52, 134/53, 62, 78, 95.1, 95.3, 152, 153, 115 R, 104.1, 201

[56] References Cited

U.S. PATENT DOCUMENTS

| | | | |
|---|---|---|---|
| 4,211,745 | 7/1980 | Boyd | 422/28 |
| 4,242,311 | 12/1980 | Middaugh | 422/302 |
| 4,643,776 | 2/1987 | Hollowell et al. | 134/21 |
| 4,694,846 | 9/1987 | Bouchard | 134/78 |
| 4,907,747 | 3/1990 | Kim | 239/578 |
| 5,251,652 | 10/1993 | Strauser et al. | 134/84 |

FOREIGN PATENT DOCUMENTS

| | | |
|---|---|---|
| 1 024 875 | 2/1958 | Germany . |
| WO 95/23103 | 8/1995 | WIPO . |

*Primary Examiner*—Frankie L. Stinson
*Assistant Examiner*—Paul J. Lee
*Attorney, Agent, or Firm*—Friedrich Kueffner

[57] ABSTRACT

A device for or in a garbage truck, particularly a vehicle for receiving and transporting so-called biological or organic garbage, includes tilting arrangements at the end of the vehicle for tilting a can containing garbage upwardly for emptying the can and for tilting the can backwardly into its initial position after the can has been emptied. The garbage dropped into the hold of the vehicle and the emptied can are sprayed with a disinfecting agent for treating the garbage and cleaning the can. The spraying device includes a spray nozzle which is movable between a first spray position for spraying in the direction of the garbage in the hold of the garbage truck and a second spray position for spraying in a second spray direction in which the spray jet is directed into the interior of the can which is in its upwardly tilted position. In addition, a control is provided which, after the can has been emptied, starts spraying of the garbage in the first spray position and which, subsequently and before tilting the can back into its initial position, moves the spray nozzle into the second spray position and carries out spraying of the interior of the empty can.

25 Claims, 7 Drawing Sheets

DEVICE FOR OR IN GARBAGE TRUCKS

BACKGROUND OF THE INVENTION

1. Field of the Invention

The present invention relates to a device for or in a garbage truck, particularly a vehicle for receiving and transporting so-called biological or organic garbage. The garbage truck includes tilting arrangements at the end of the vehicle for tilting a can containing garbage upwardly for emptying the can and for tilting the can backwardly into its initial position after the can has been emptied. The garbage dropped into the hold of the vehicle and the emptied can are sprayed with a disinfecting agent for treating the garbage and cleaning the can.

2. Description of the Related Art

Garbage generated in households and also in businesses have for some time now been separated into different types of garbage to be collected and further processed, such as, paper, plastic materials, etc.; in the same manner, a separate collection of perishable organic materials, particularly food leftovers is carried out in separate containers. This type of waste is decomposed by bacteria and is to be used later for composting in gardens, etc. Accordingly, this type of garbage has been called organic garbage. This organic garbage has the significant disadvantage that in the containers for collecting the garbage, also called organic garbage cans, large quantities of mold fungus which are detrimental to health are formed. The aspergillus spores formed in the cans may be life threatening for allergic persons. Particularly affected are garbage disposal personnel who may breathe these poisonous spores when emptying the organic garbage cans. Moreover, children and persons having weakened immune systems are particularly endangered.

In order to at least partially eliminate the above described disadvantages of garbage, particularly the so-called organic garbage, it is known in the art to provide in the garbage truck above the hold for the garbage or organic garbage a spraying device which sprays the garbage introduced into the hold with a liquid which disinfects the garbage, as disclosed, for example, in DE-PS 74 686, DE-PS 81 195, DE-PS 112 628 and DE-GM 94 03 313.7. As long as organic garbage is involved it can be stated that spray agents can be used that do not impair the quality of the organic garbage. When the disinfection described above is carried out, any annoying odor of the garbage or organic garbage which is partially being decomposed is eliminated or at least reduced.

However, in these known spraying devices, only the garbage already dropped into the hold of the garbage truck is treated; not treated are the garbage residues that still adhere to the inner walls and the bottom of the can after the can has been emptied. When the users of the cans do not ensure that the cans are cleaned or the cans are sprayed with a disinfecting agent, for example, the aspergillus spores remain adhering to the can, reproduce and continue to pose a potential danger for any person who opens the can for introducing new organic garbage. The same is true for the garbage disposal personnel who manipulate the cans and bring the cans to the garbage truck for emptying the cans because when the cans are tilted upwardly into the disposal position, the covers of the cans open automatically and any aspergillus spores that are present are distributed in the environment. Experience has shown that, for reasons of laziness or forgetfulness, the emptied organic cans are not cleaned or disinfected as described above. While it is known in the art to provide spraying devices for disinfecting the empty garbage cans, as disclosed, for example, in DE-PS 938 299 and DE-PS 2 056 039, these arrangements are also incomplete because the garbage removed from the garbage cans is not sprayed and disinfected by these arrangements.

Finally, DE-AS 10 24 875 discloses a procedure in which a single spray nozzle adjustable in only one spraying direction initially sprays a disinfecting agent onto the garbage dropping out of the can and subsequently sprays the disinfecting agent into the interior of the can and at the cover of the can in order to disinfect the can. This procedure has several disadvantages. The disinfectant is only sprayed against those portions of the garbage that are at the bottom in the hold after the garbage drops into the hold. This means that the upper layer of the garbage is not sprayed. This results in the production of the above described disadvantageous odor and may also cause the formation of mold fungi. In addition, with a single adjustment of the spraying device, it is not possible to achieve in an optimum manner spraying of the garbage which drops down and also of the interior of the can. This is particularly true when cans having different inner cross-sections and lengths are to be emptied and sprayed in the same garbage truck.

SUMMARY OF THE INVENTION

Therefore, it is the primary object of the present invention to provide a device which makes it possible with relatively simple structural means to ensure that the garbage dropped into the garbage as well as the garbage can are completely disinfected.

In accordance with the present invention, the spraying device includes a spray nozzle which is movable between a first spray position for spraying in the direction of the garbage in the hold of the garbage truck and a second spray position for spraying in a second spray direction in which the spray jet is directed into the interior of the can which is in its upwardly tilted position. In addition, a control is provided which, after the can has been emptied, starts spraying of the garbage in the first spray position and which, subsequently and before tilting the can back into its initial position, moves the spray nozzle into the second spray position and carries out spraying of the interior of the empty can.

While the above description only mentions a single garbage can, the present invention is also directed to the conventional embodiment of garbage trucks in which two garbage cans can be placed against the rear wall of the garbage truck next to each other and can be independently emptied.

The device according to the present invention makes it possible that the interior of the can is sprayed with the disinfecting agent after the can has been emptied, so that any garbage residues which are still present in the can, including aspergillus spores, are destroyed or removed and the stench of garbage, particularly of organic garbage, which is very unpleasant during hot weather, is at least reduced without requiring activity of a person in a household or business who is in charge of the garbage cans. Another advantage is the fact that the same spraying device which sprays the disinfecting agent onto the garbage dropped into the hold of the vehicle is also used for disinfecting the cans. As a result, the costs of a second separate spraying device and the attendant space requirement are avoided. A particular advantage is the fact that, when different types of garbage cans having a different cross-section or length are used, it is easily possible to adjust the spray direction of the spraying device when the spraying device is in the second spray position.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 2:
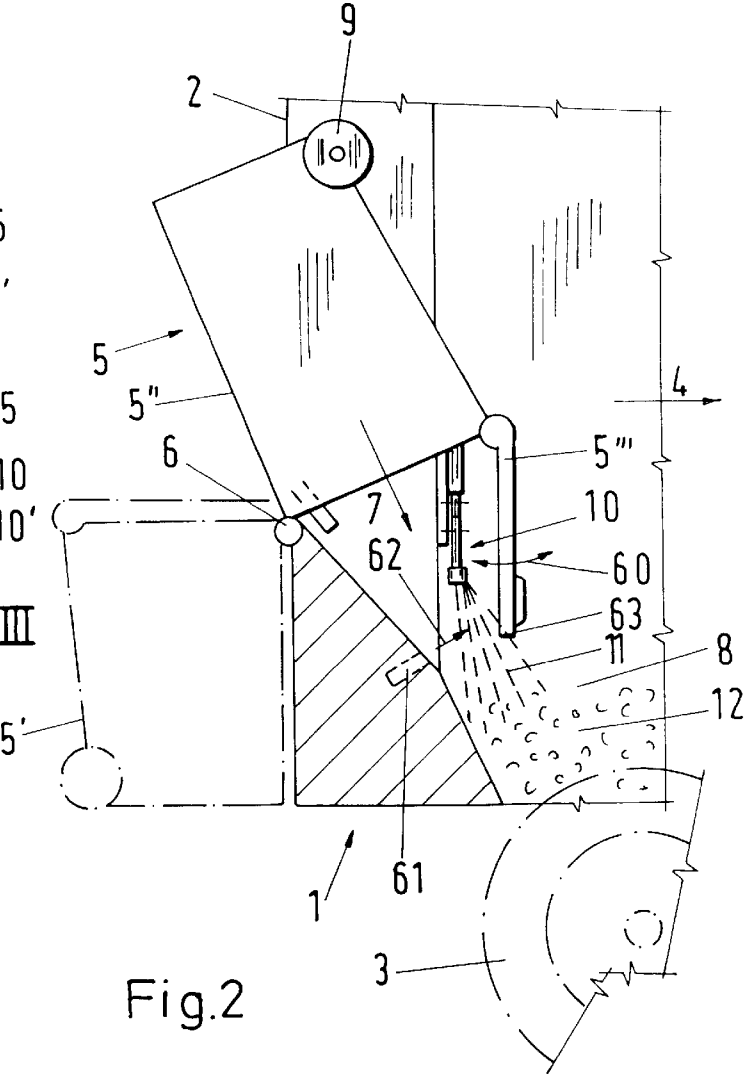
FIG. 2 is a side view, partially in section, taken along sectional line II—II in FIG. 1.
Figure 1:
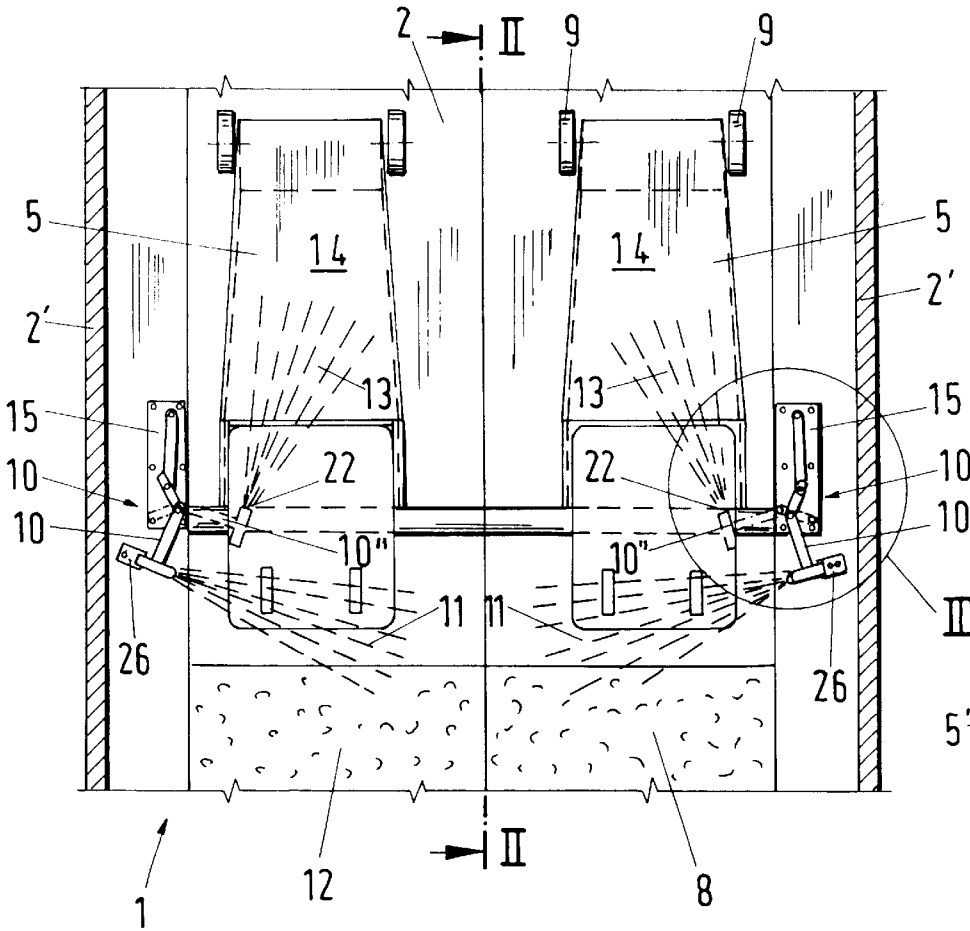
FIG. 1 is a schematic partial sectional view of the interior of a garbage truck showing the rear wall of the vehicle with two upwardly tilted garbage cans and two spray devices.

FIGS. 1 and 2 of the drawing show parts of a garbage truck 1 with a rear wall 2 and a rear wheel 3, shown in dash-dot lines. The front portion of the garbage truck which is not of interest is located in the direction of arrow 4 which also indicates the travel direction of the garbage truck 1.

The garbage disposal personnel place the organic garbage cans 5 to be emptied in the known manner on a tilting unit which tilts the can 5 from the position 5' shown in dash-dot lines in FIG. 2 about the axis 6 upwardly into the emptying position 5". In this position 5", the cover 5'" has opened and the organic garbage drops in the direction of arrow 7 into the hold 8 of the garbage truck 1. The organic cans 5 are equipped with travel rollers 9.

FIGS. 1 and 2 show a spraying device 10 to be explained in more detail with the aid of FIGS. 3 to 8. The spraying device 10 is movable between two end positions, i.e., the first spray position 10' shown in solid lines and the second spray position 10" shown in broken lines. In the spray position 10', the spray device 10 sprays in the direction 11 onto the organic garbage 12 which has been dropped into the hold 8 of the garbage truck. In the second spray position 10', spraying is effected in the direction 13 into the interior 14 of the cans 5 in such a way that the inner walls of the cans as well as the bottom of the cans are reached by the spray jet. The time sequence of these spraying procedures and the control thereof will be explained in more detail with the aid of FIG. 10. The nozzles 22 of the spraying devices 10 are so-called two-material nozzles into which air is forced and the spray agent is introduced, so that air and spray agent emerge together as a spray mist. The manner in which the disinfecting liquid is supplied will be explained in more detail with the aid of FIGS. 11–15.

Figure 3:
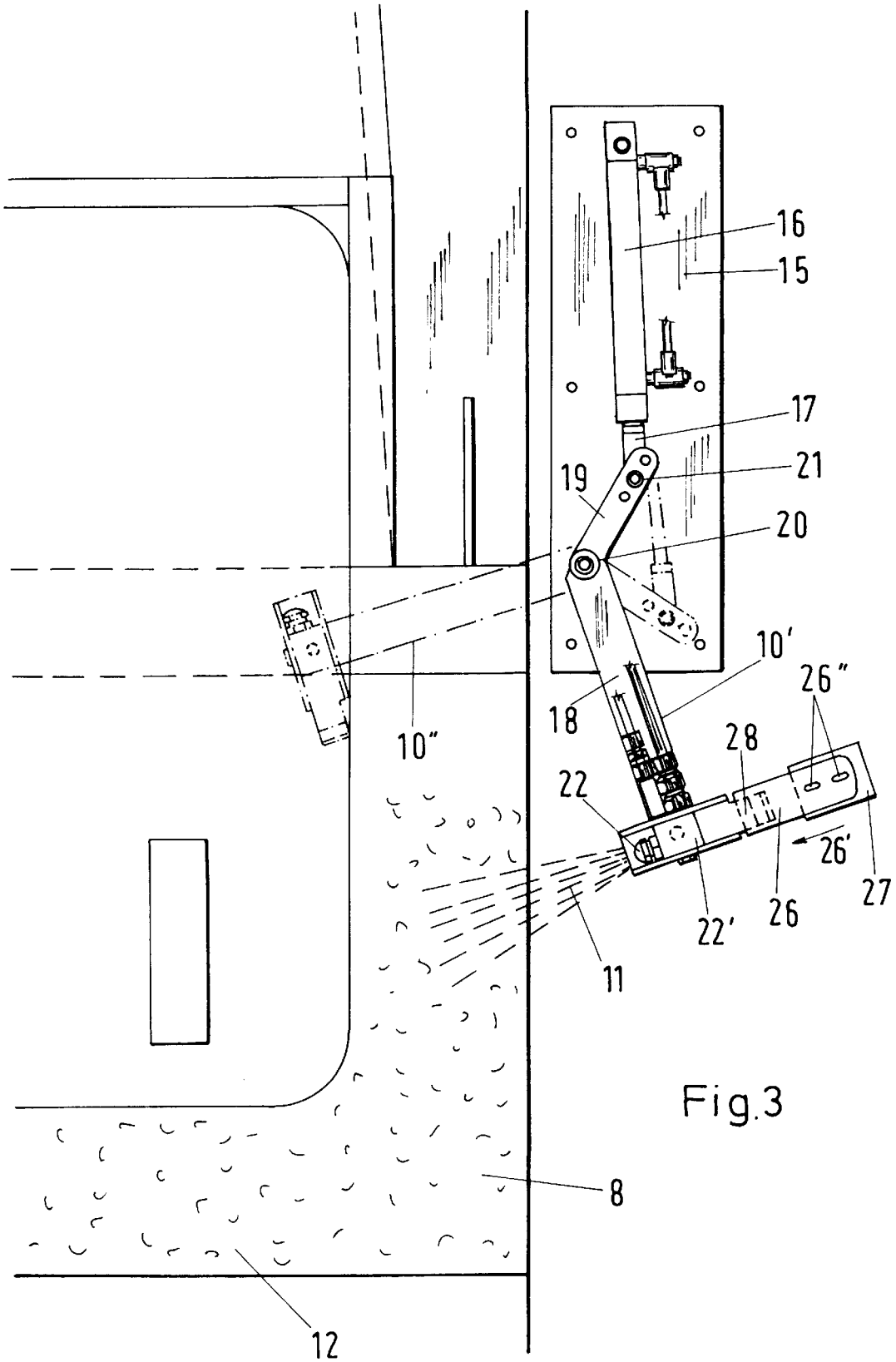
FIG. 3 is a side view, on a larger scale, of the detail III of FIG. 1, wherein the spray device is in the first spray position for spraying disinfectant onto the garbage in the hold of the vehicle.
Figures 4, 8:
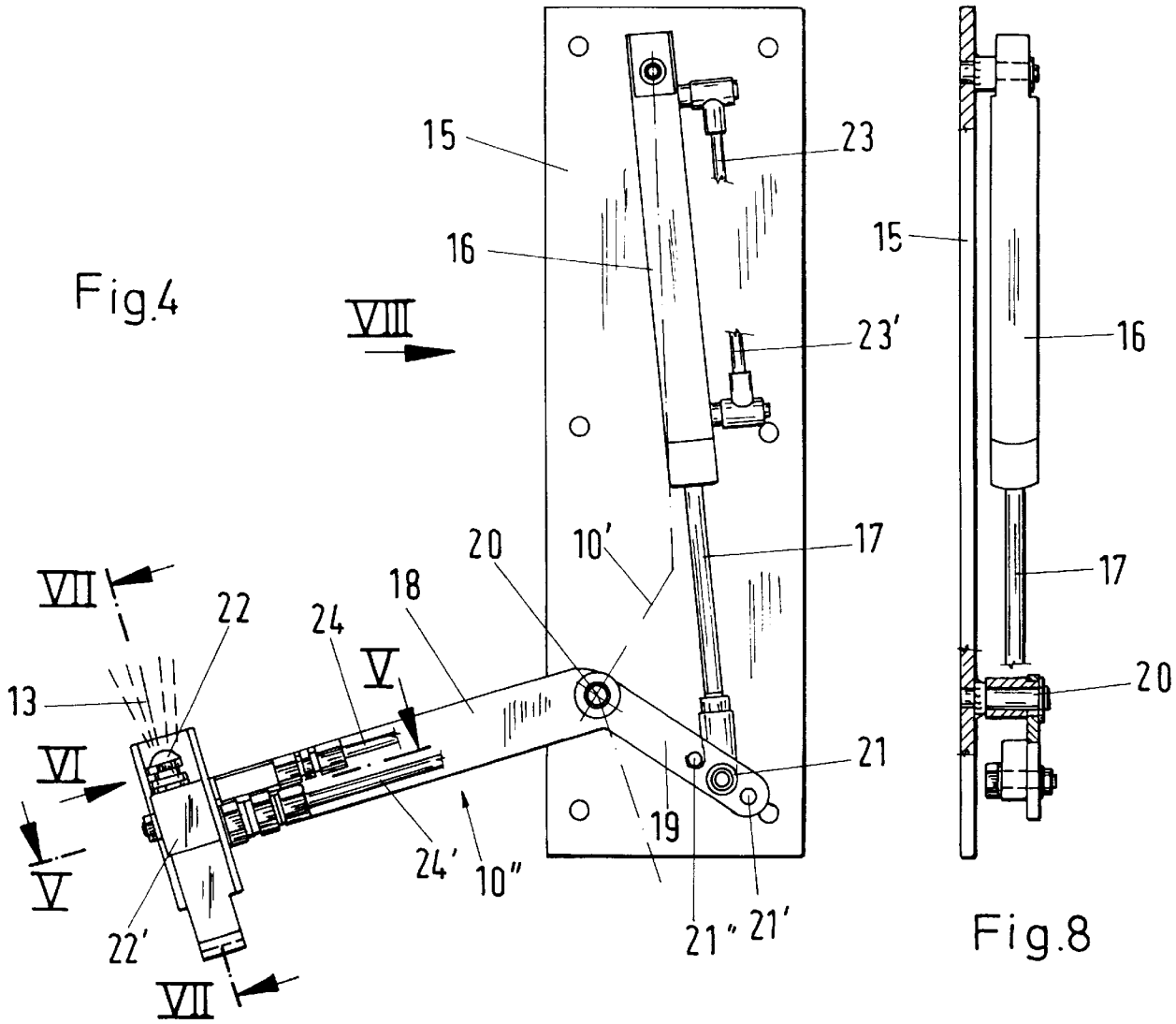
FIG. 4 is a side view analogous to FIG. 3, again on a larger scale, showing the device in the second spray position for spraying the interior of the can.
FIG. 8 is a view in the direction of arrow VIII of FIG. 4.

The spraying devices 10 may be mounted on a base plate or support plate 15 which is attached to the rear wall 2 of the garbage truck. Preferably, the plate 15 is releasably screwed onto the back wall 2. A pneumatically or hydraulically actuated lifting cylinder 16 with lifting piston 17 is mounted on the plate 15. I addition, an angle piece composed of two arms 18, 19 extending at an angle relative to each other is hinged in an articulated manner to the plate 15 at 20, to that the angle piece is pivotable. As shown in FIGS. 3 and 4, one arm 19 is connected to a hinge point, formed by a bore 21, of the lifting piston 17. For changing the transmission ratio of the pivoting movement, the piston can also be connected to one of the adjacent bores 21' or 21". The other arm 18 supports the spray nozzle 22. The lifting piston 17 serves to move the angle piece between the first spray position 10' shown in solid lines in FIG. 3 and the second spray position 10". In the first spray position 10', the lifting piston 17 is retracted in the lifting cylinder 16. The angle piece is shown in its second spray position 10" in broken lines in FIG. 3, while it is shown in solid lines in FIG. 4. In order to reach this position, the lifting piston 17 is pushed out of the lifting cylinder 16. FIG. 4 additionally shows in dash-dot lines the position of the arms 18, 19 in the spray position 10'.

As is apparent from the drawing, in the first spray position 10' in FIG. 3, the spray jet 11 sprays onto the garbage 12 dropped into the garbage truck; on the other hand, in second spray position 10", the spray jet 13 is directed into the interior of the garbage can. The hydraulic or pneumatic medium is supplied through supply lines and discharge lines 23, 23' to the lifting cylinder 16. Supply lines 24 for the medium to be sprayed and 24' for the compressed air are provided in the arm 18 supporting the spraying device 10. The plate 15 for mounting the spraying devices are located between the respective can 5 and the corresponding outer wall 2'.

In the position 5" of the garbage can 5 for emptying the garbage can 5, see especially FIG. 2, the cover 5'" of the garbage can 5 can swing back and forth about its hinge axis 59 as indicated by double arrow 60. This means that the cover may project into the pivoting path of the spray nozzle 22 and of the arm 18 supporting the nozzle 22 from the first spray position 10' shown in FIG. 2 into the second spray position 10'. However, this would impede the pivoting movement of the angle piece described above, which could cause damage to these parts. In order to avoid this, a compressed air spray nozzle 61 is provided at the rearward wall of the hold 8 in such a way that the air jet 62 emanating from the nozzle 61 is directed against the cover 5'", preferably against the free end 63 of the cover. The compressed air spray nozzle 61 is switched on by means of the control when the first spraying procedure has terminated. The air flow 62 of the compressed air spray nozzle which is now switched on holds the cover 5'" in a position in which it is slightly swung outwardly from the position shown in FIG. 2. The spray nozzle 22 can now be pivoted unimpededly into the second spray position 13. After the second spraying procedure in position 13 has been concluded, i.e., the interior of the can has been cleaned, and the spray nozzle has been moved back into the first position shown in FIG. 2, the compressed air supply to the compressed air spray nozzle is again switched off.

As also shown in FIG. 1, in accordance with a preferred embodiment of the invention, a spraying device including the means for actuating the spraying device can be provided on the driver's side, usually the right half as shown in FIG. 1, as well as on the passenger side, usually the left half in FIG. 1. Accordingly, two cans 5 and the garbage dropped from the cans can be sprayed simultaneously.

Figure 6:
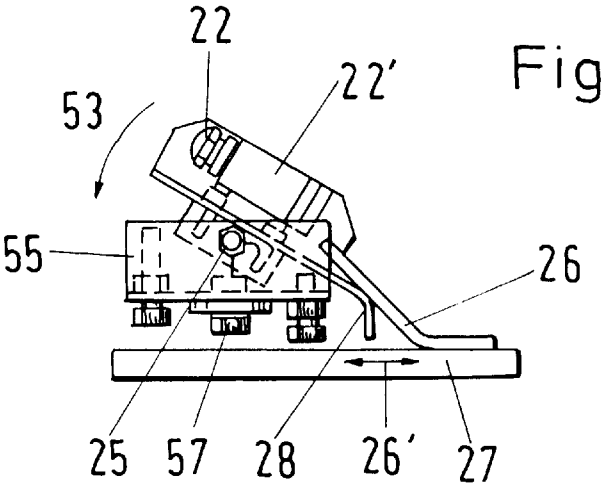
FIG. 6 is a view in the direction of arrow VI in FIG. 1 after tilting.
Figure 7:
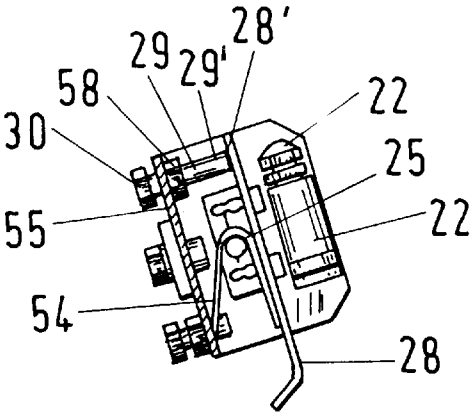
FIG. 7 is a sectional view taken along sectional line VII—VII of FIG. 4.
Figure 9:
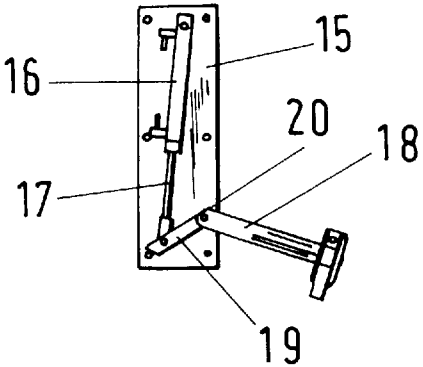
FIG. 9 shows, on a smaller scale, the control with spray nozzle in the second spraying position shown in the left half of FIG. 1.
Figure 5:
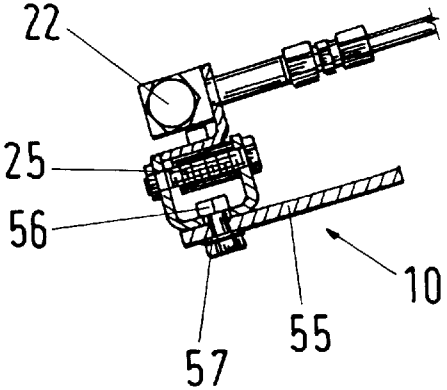
FIG. 5 is a sectional view taken along sectional line V—V in FIG. 4.

Depending on the spatial arrangement and position of the upwardly tilted cans, the hold of the garbage truck and the above-described components of the spraying device and means for actuating the device, it may be necessary that the spray nozzle 22 assumes relative to the components supporting the spraying device 10 a different position in the first spray position as compared to the second spray position. For this purpose, as shown in FIG. 5, the spray nozzle 22 is rotatable with its housing 22' about a bearing bolt 25 which is mounted on the angle piece arm 18 of the spraying device 10. Moreover, a counter-stop member 28, shown in FIGS. 6 and 7, is provided together with the spray nozzle 22, wherein a stop plate 26 is mounted on an abutment 27 in the moving path of the counter-stop member 28. The stop plate 26 is fixedly attached to the interior of the vehicle housing. The counter-stop member 28 is fixedly connected to the spray nozzle housing 22'. The counter-stop member 28 may also be constructed in one piece with the housing 22'. When the respective spraying device 10 is pivoted to the right into the first spray position in accordance with FIG. 3, the counter-stop member 28 comes into contact with the stop plate 26. The stop plate 26 is movable in the direction 26' relative to the abutment 27 and, thus, relative to the vehicle housing and the stop plate 26 can be locked relative to the abutment 27. For example, this can be effected by means of two oblong holes 26' of the stop plate 26 and tightening screws extending through the holes 26". To the extent that the stop plate 26 is moved toward the left as seen in FIG. 3, i.e., against the pivoting direction of the spray nozzle, at the beginning of the contact of the counter-stop member 28 against the stop plate 26, the spray nozzle housing 22' is increasingly pivoted against the direction of arrow 53, shown in FIG. 6, about the bearing bolt 25 against the force of a spring 54. This adjustment of the displacement position of the stop plate 26 relative to the abutment 27 only has to be carried out once at the beginning of operation of the respective vehicle. The same is true for the adjustment of the adjusting screw 30 which will be explained below.

The bearing bolt 25 is supported by a support stirrup 55. This support stirrup 55 may be rotatable relative to the angle piece arm 18 about the longitudinal axis of an adjusting screw 56, wherein the adjusted position can be fixed by means of a nut 57, as shown in FIG. 5. FIG. 7 shows that the spring 54 is wound in the form of a spiral spring about the bearing bolt 25, wherein the two spring arms have the tendency to move apart from each other. One spring arm rests against the counter-stop member 28 and the other arm of the spring rests against the bottom surface of the support stirrup 55. Consequently, through the position of the stop plate 56 and any required pivoting of the support stirrup 55 about the screw 56, the desired spray direction 11 of the nozzle 22 in the first spray position relative to the garbage dropped into the hold is adjusted, as shown in FIG. 3.

As the spraying device 10 is pivoted into the second spray position 10", shown in broken lines in FIGS. 1 and 3, the counter-stop member 28 is pivoted away from its contact position with the stop plate 26. Consequently, the spring 54 can pivot the spray nozzle housing 22' with the spray nozzle 22 to such an extent in FIG. 7 in a counter-clockwise direction about the bearing bolt 25 until the bottom of the housing 22', or the upper end 28' of the counter-stop member 28 as seen in FIG. 7, has come into contact with the free end face 29' of an adjusting screw 29. The position of this free end 29' can be changed by adjusting the screw 29 by means of its screw head 30 in the longitudinal direction 30 thereof. The screw 29 can be secured by a counter-nut 28. As a result, by the above-described screw adjustment 29/30/58 in the second spray position 10", the spraying direction of the nozzle 22 and, thus, the spray jet 13 can be readjusted in such a way that this spray jet is directed into the interior of the can and simultaneously sprays against the inner walls of the can and also the bottom thereof.

Figure 10:
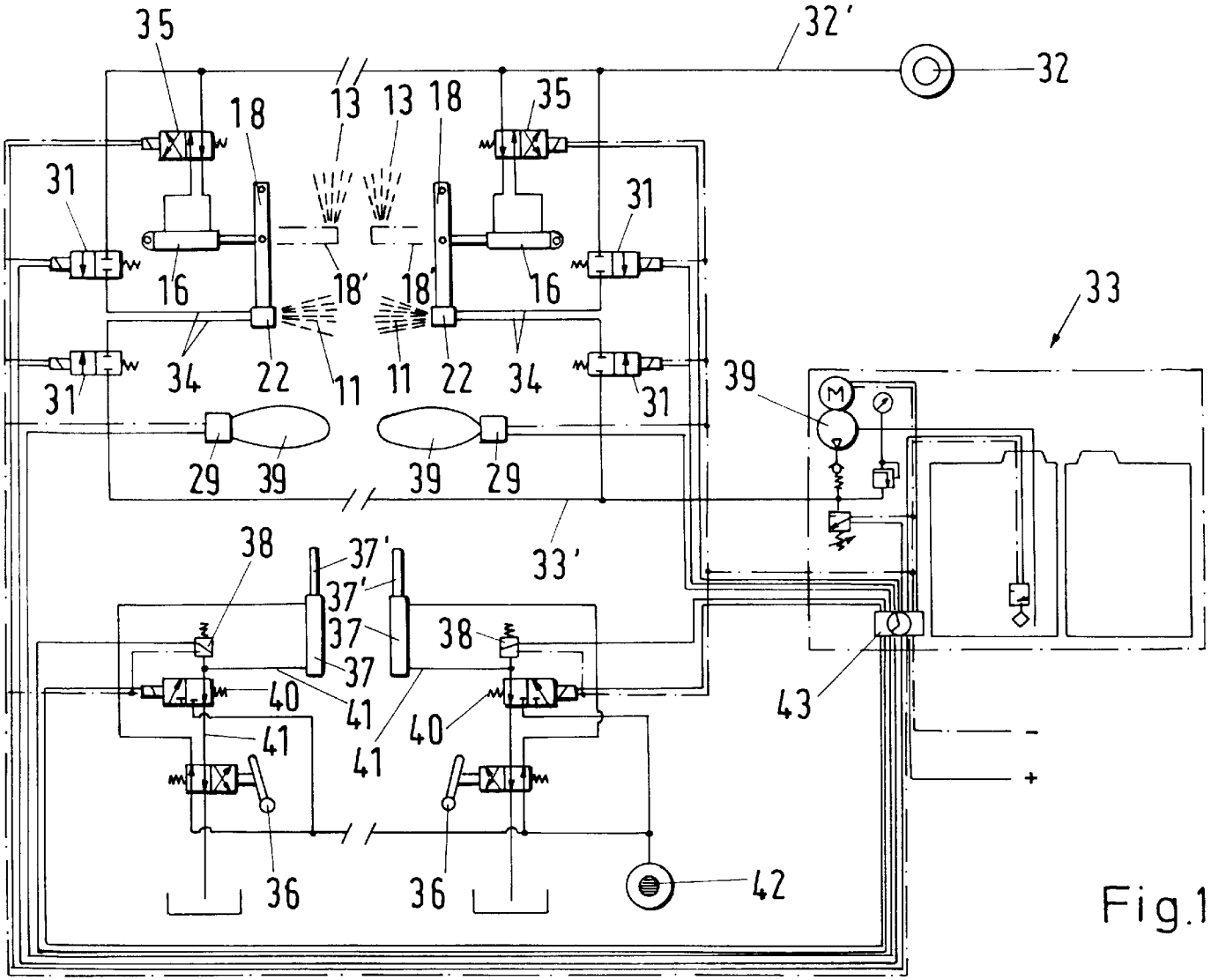
FIG. 10 is a circuit diagram of the control.
Figure 13:
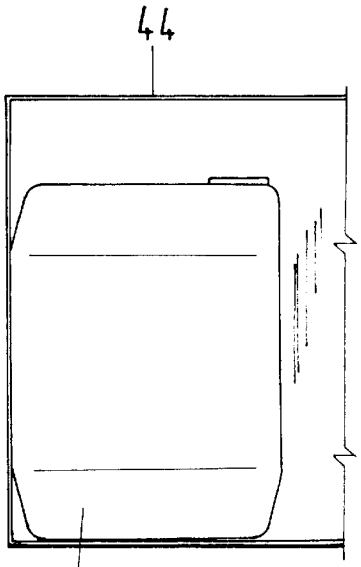
FIGS. 12 and 13 are side views in the direction of arrows XII and XIII, respectively, in FIG. 11, wherein the side walls of the housing of the containers are removed.
Figure 11:
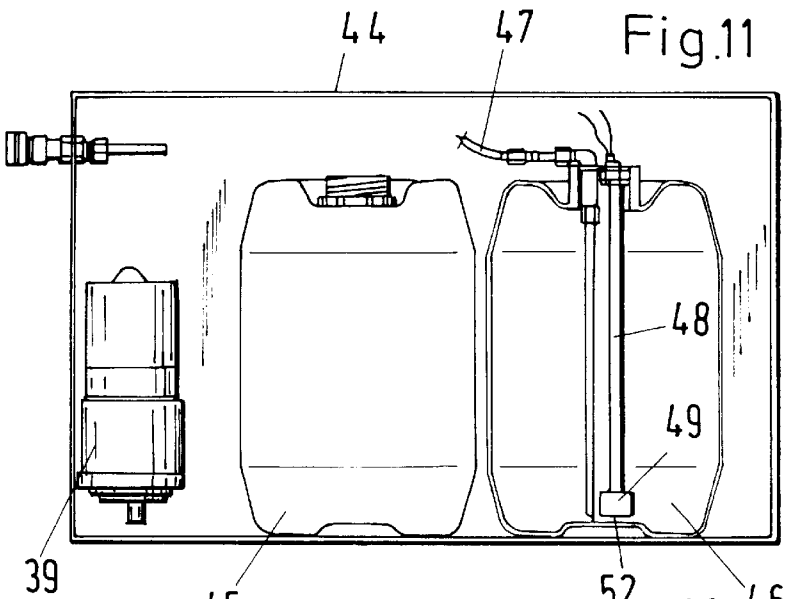
FIG. 11 shows a container arrangement for receiving and pumping the spray liquid.
Figure 14:
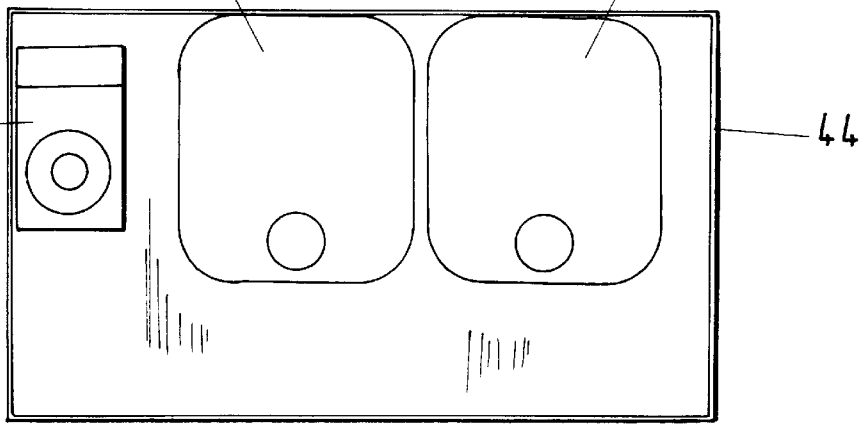
FIG. 14 is a top view of the arrangement of FIG. 11.
Figure 12:
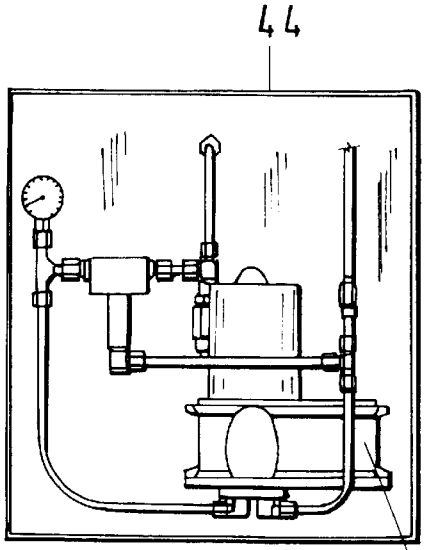

FIG. 10 schematically shows the pivoting devices including the angle pieces 18, wherein the spray nozzles 22 and spray jets 11 are in a position for spraying the garbage 12 in the hold 8. This spraying procedure is started after the garbage drop from the upwardly tilted cans has traveled through radar pulses 30 emitted by a transmitter 29. Subsequently, by means of an electric control, not shown in detail, hydraulic or pneumatic valves 31 are opened which release the supply of compressed air from the pneumatic pressure source 32 and the supply of liquid to be sprayed to the nozzles 22 from the liquid source 33. The corresponding lines for the compressed air are denoted by reference numeral 32' and the lines for the liquid are denoted by reference numeral 33'.

The duration of spraying the garbage 8 dropped in the hold 12 is adjustable. After the spraying procedure, the control closes the valves 31. Subsequently, additional pneumatically or hydraulically operated valves 35 are opened which supply the pressure medium to the respective lifting cylinder 16 in such a way that the pivoting device 18 pivots by 90° from the position shown in FIG. 10 in solid lines into the position 18' shown in broken lines. The spray nozzles now have assumed a position in which they spray into the cans as indicated by 13, as already explained in connection with FIG. 1. Subsequently, the control opens the valves 31, preferably after a preadjusted time period. Consequently, the interiors of the empty cans are now sprayed, the valves 31 are now closed and the control causes the cans to be tilted downwardly from the position 5 shown in FIG. 2 into the position 5'. Simultaneously, the spraying devices are pivoted back into the position 18 shown in FIG. 10.

Accordingly, it is now possible to use a single spraying device for successively and in a controlled manner spraying the garbage dropped into a garbage truck as well as the interior of the garbage cans.

The bottom half of FIG. 10 shows the device to be actuated by the garbage disposal personnel, i.e., a hand lever 36 for tilting the cans 5 upwardly into the upper position 5 as shown in FIG. 2 and for tilting the cans 5 back into the lower position 5' as shown in dash-dot lines in FIG. 2. However, it is necessary to prevent the operator from starting the return tilting movement too early which would mean that spraying of the garbage cans is entirely or partially prevented. For this purpose, pressure switches 38 are provided which, when the lever for actuating lifting of the respective can is operated, switches on a gear pump 39 for the liquid to be sprayed, so that the liquid reaches the spray nozzles through the lines 34 after the valves 31 have been opened. As soon as the radar pulses 30 have responded, i.e, the cans are in the upwardly tilted position and the garbage has been dropped, a hydraulic solenoid valve 40 is switched on, so that a line connection 41 from a hydraulic pump 42 to the hydraulic lifting cylinders is closed. As long as these cylinders with their lifting pistons 37' are pressurized by the hydraulic pressure of the pump 42, the cylinders hold the cans in the upwardly tilted position. After the second spraying procedure and the time adjusted for this purpose at a clock 43 have ended, the pivot levers 18 are pivoted from the position 18' into the vertical position illustrated with solid lines. Simultaneously, a control of the solenoid valve 40 takes place in such a way that the line connection 41 is interrupted. This means that the pressure in the hydraulic lifting cylinders drops and the lifting pistons 37' can return as a result of the weight of the respective can into the lifting cylinders 37, so that the respective can can assume the position 5' shown in dash-dot lines in FIG. 2.

Figure 15:
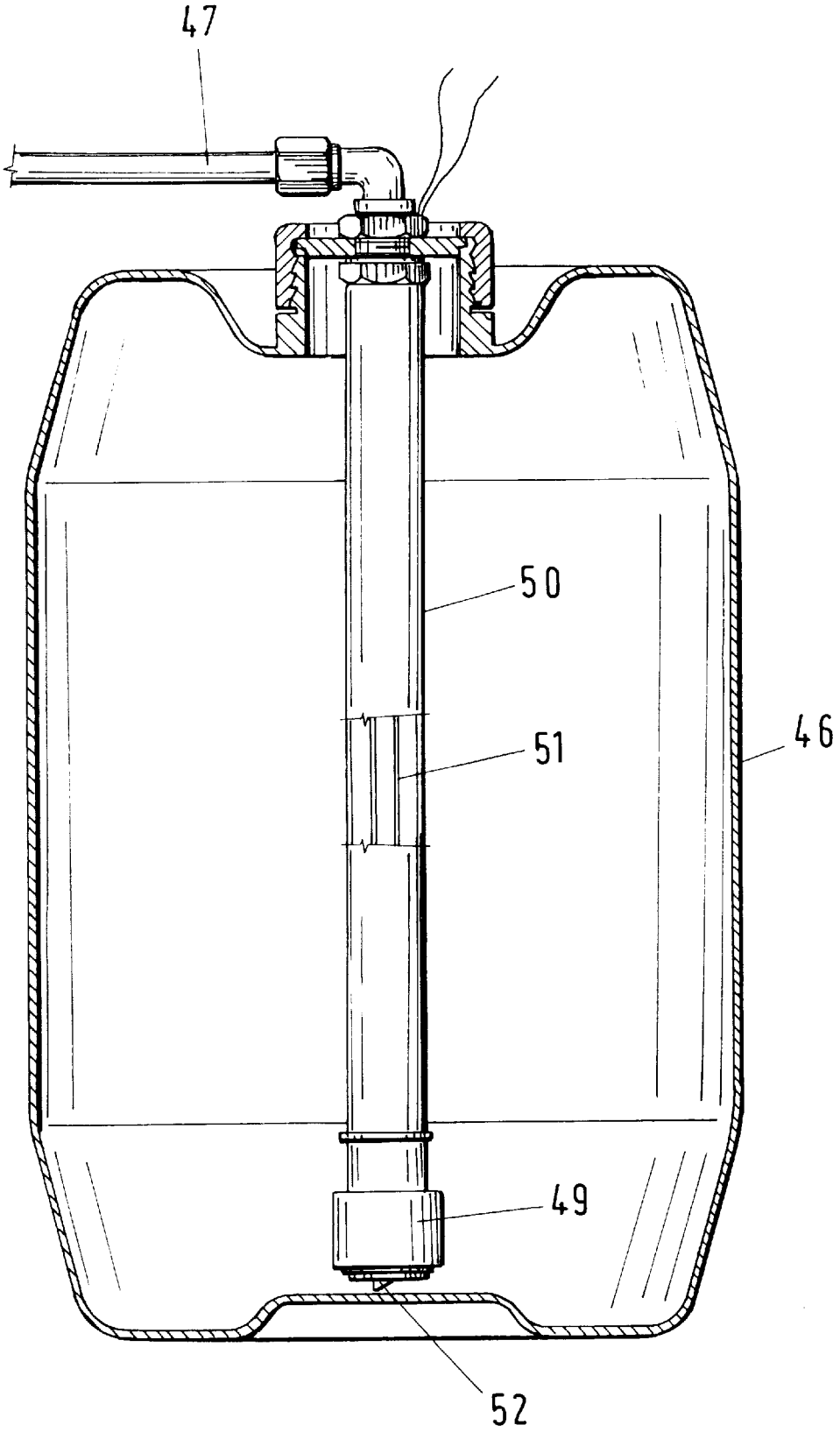
FIG. 15 is a sectional view, on a larger scale, of another embodiment of a liquid container according to the present invention.

The right hand sides of FIG. 10 and FIGS. 11–14 show the arrangement composed of two containers 45, 46 in a common housing 44 for the liquid to be sprayed as well as the gear pump 39. One of the two containers 45, 46 is intended as a back-up, while the other container has a connection 47 for drawing out the spraying liquid contained in the container. A float 49 is provided in a separate pipe 48 provided preferably concentrically in the interior of the container, wherein the float 49 is guided so as to slide in vertical direction. The float 49 is visible from the outside so that the operator can see how much spray liquid is still contained in the container. FIG. 15 shows a different embodiment in which the suction pipe 20 leading to the connection 47 and the guide 51 for the float 49 are inserted into each other.

Instead of providing a visible float 49, it is also possible to provide in the lower part of the arrangement a reed contact 52 which is actuated by the float 49 when the float 49 reaches the bottom area and a display signal is actuated.

While specific embodiments of the invention have been shown and described in detail to illustrate the inventive principles, it will be understood that the invention may be embodied otherwise without departing from such principles.

I claim:

1. A device for or in a garbage vehicle for receiving and transporting garbage, particularly organic garbage, the vehicle having a hold, the device comprising tilting arrangements at an end of the vehicle for tilting a garbage can each containing garbage upwardly into a tilted position for emptying the can into the hold of the vehicle and for tilting the can backwardly into an initial position after the can has been emptied, a spraying device for spraying with disinfecting agent the garbage dropped into the hold of the vehicle and for treating the garbage and cleaning the can, the spraying device comprising a spray nozzle configured to be movable between a first spray position for spraying in a first spray direction toward the garbage in the hold of the vehicle and a second spray position for spraying in a second spray direction in which a spray jet is directed in an interior of the can when the can is in the upwardly tilted position, and control means configured to start spraying of the garbage in the first spray position after the can has been emptied, and, subsequently and before tilting the can back into the initial position, to move the spray nozzle into the second spray position for carrying out spraying of the interior of the emptied can.

2. The device according to claim 1, wherein the spraying device comprises connections for supplying spraying agent and compressed air, the spraying device together with the spray nozzle being pivotally attached at a fixed point of the vehicle so as to be pivotable between first and second end positions, wherein the first end position corresponds to the first spray position and the second end position corresponds to the second spray position.

3. The device according to claim 2, further comprising a base plate, the spray device being mounted on the base plate.

4. The device according to claim 3, comprising a hydraulically or pneumatically operated actuating means fixedly attached to the base plate, wherein the actuating means supports the spraying device for pivoting the spraying device between the first and second end positions.

5. The device according to claim 4, wherein the actuating means comprises a lifting cylinder with lifting piston.

6. The device according to claim 4, wherein the spray device comprises first and second arms, the fixed point being located between the first and second arms, wherein the first arm is configured to act on the actuating means and the second arm supports the spray nozzle.

7. The device according to claim 6, wherein the spray device comprises an angular angle piece, the angle piece forming the first and second arms.

8. The device according to claim 7, wherein the spray nozzle is mounted so as to be pivotable relative to the angle piece and so as to be securable in a pivoted position.

9. The device according to claim 8, comprising a stop plate, wherein the pivoted position of the spray nozzle relative to the spray device is securable by contacting a counter-stop means of a housing of the spray nozzle, the stop plate being attached to a vehicle body or to an abutment of the vehicle housing.

10. The device according to claim 9, wherein the stop plate is shiftable essentially in a longitudinal direction of the spray nozzle housing and is securable in a shifted position.

11. The device according to claim 10, comprising a support stirrup for supporting the support plate.

12. The device according to claim 9, wherein the spray nozzle and the spray nozzle housing are mounted so as to be pivotable about a bearing bolt, wherein, when the stop plate and the counter-stop member are pressed together, the spray nozzle and the spray nozzle housing are pivoted against the force of a spring about the bearing bolt.

13. The device according to claim 12, wherein, when a contact between the counter-stop member and the stop plate is released, the spring is configured to pivot the spray nozzle and the spray nozzle housing about the bearing bolt until the spray nozzle housing comes into contact with an adjustable stop member.

14. The device according to claim 13, wherein the stop member is comprised of an adjusting screw which is adjustable in the pivoting direction of the spray nozzle housing, comprising a counter-nut for securing the adjusting screw in a desired pivoted position.

15. The device according to claim 1, wherein the vehicle comprises at a rear wall thereof two tilting arrangements, a spray device being provided for each can being tilted by the respective tilting arrangement.

16. The device according to claim 15, wherein the rear wall of the vehicle has means for connecting the rear wall to each can in an articulated manner and openings for receiving each can in the upwardly tilted position thereof, wherein the spray devices and actuating means therefor are each mounted between one of the cans and a corresponding outer wall of the vehicle.

17. The device according to claim 1, wherein each spray nozzle is a two-component nozzle with supply means for compressed air and for the disinfecting agent to be sprayed.

18. The device according to claim 2, wherein the control means is configured to control pivoting of the spray devices between the first and second end positions and for opening and closing the spray nozzle such that dropping of the garbage into the hold is detected, the spray nozzle of the spray device in the first end position is opened, after a preadjustable spraying period the nozzle is closed and the spray device is pivoted into the second end position and, subsequently, the spray nozzles are opened after a predeterminable time and are subsequently closed again, and finally the cans are released into the initial position and simultaneously the spraying device is moved into the first spray position.

19. The device according to claim 18, further comprising hydraulically or pneumatically actuated valves for the control means.

20. The device according to claim 18, comprising a manual actuating means for tilting the can from the upwardly tilted position into the initial position, means for locking the manual actuating means for blocking the return pivoting of the can while spraying in the first and second spray position has not yet been concluded.

21. The device according to claim 1, wherein the can has a cover, the vehicle having a housing, a compressed air spray nozzle being attached to the housing, the compressed air spray nozzle being mounted in a position in which the compressed air spray nozzle is located opposite the cover when the cover hangs downwardly from the can when the can is in the upwardly tilted position, wherein the compressed air spray nozzle produces a compressed air jet directed against an inner side of the cover.

22. The device according to claim 21, further comprising control means for switching on compressed air supplied to the compressed air spray nozzle after spraying in the first spray direction has concluded and prior to pivoting the spray device into the second spray position, and for switching off the compressed air supply after spraying in the second spray position has been concluded.

23. The device according to claim 1, comprising at least one liquid container for the disinfecting-agent to be sprayed, further comprising a gear pump for withdrawing the agent from the container.

24. The device according to claim 23, comprising a float for indicating a level of the liquid agent in the container.

25. The device according to claim 24, wherein the float is configured to indicate total or substantial emptying of the container.

* * * * *